US005778572A

United States Patent [19]

Lukavich et al.

[11] Patent Number: 5,778,572

[45] Date of Patent: Jul. 14, 1998

[54] WEAR RESISTANT CUTTING EDGE AND METHOD FOR MAKING SAME

[75] Inventors: Paul J. Lukavich, Washington; Thomas D. Holtz, Peoria; Charles L. McDaniel, Jr., Metamora, all of Ill.

[73] Assignee: Caterpillar Inc., Peoria, Ill.

[21] Appl. No.: 763,651

[22] Filed: Dec. 11, 1996

[51] Int. Cl.[6] ..... E02F 3/00

[52] U.S. Cl. ..... 37/460; 37/755; 299/113; 172/701.3

[58] Field of Search ..... 37/460, 219, 454, 37/444, 450, 451, 452, 455, 266, 264, 903, 446; 299/113, 111, 79; 175/427, 426; 76/101.1; 172/701.3, 747, 703

[56] References Cited

U.S. PATENT DOCUMENTS

| | | | |
|---|---|---|---|
| 1,867,871 | 7/1932 | Birkenbeuel | 37/460 |
| 3,529,677 | 9/1970 | Stephenson | 37/460 X |
| 3,805,423 | 4/1974 | Engel et al. . | |
| 3,888,027 | 6/1975 | Toews | 172/701.3 X |
| 3,934,654 | 1/1976 | Stephenson et al. | 172/747 X |
| 4,052,802 | 10/1977 | Moen et al. | 172/701.3 X |
| 4,086,966 | 5/1978 | Lanz et al. | 172/701.3 |
| 4,715,450 | 12/1987 | Hallisey et al. | 172/701.3 |
| 4,821,819 | 4/1989 | Whysong | 299/113 |
| 4,883,129 | 11/1989 | Lonn et al. | 172/777 |
| 5,081,774 | 1/1992 | Kuwano | 37/460 |
| 5,224,555 | 7/1993 | Bain et al. | 172/701.3 X |
| 5,427,186 | 6/1995 | Adrian et al. | 172/701.3 |
| 5,473,829 | 12/1995 | Adrian et al. | 37/446 |

FOREIGN PATENT DOCUMENTS

| | | | |
|---|---|---|---|
| 912322 | 3/1954 | Germany | 299/79 |
| 132160 | 4/1960 | Russian Federation | 299/79 |
| 706226 | 3/1954 | United Kingdom | 299/79 |
| 707021 | 3/1954 | United Kingdom | 175/426 |
| 1112446 | 5/1968 | United Kingdom | 299/113 |

OTHER PUBLICATIONS

E&E Special Products—Standard Products English & Metric Design Manual (No Date).

*Primary Examiner*—Tamara L. Graysay
*Assistant Examiner*—Thomas A. Beach
*Attorney, Agent, or Firm*—O. Gordon Pence

[57] ABSTRACT

An elongated steel cutting edge has an insert receiving slot formed therein extending from one end to the other. A plurality of carbide inserts of a generally rectangular solid configuration have a front face, a rear face and four sides. A plurality of upstanding protuberances are formed on and extend beyond the rear face of the inserts. The inserts are located within the slot in closely spaced side by side relationship and with the protuberances located against one of the sides of said slot. The front and rear faces of the cutting edge are brought together along the slot to cause a mechanical interlock between the protuberances of the insert and the cutting edge.

10 Claims, 3 Drawing Sheets

WEAR RESISTANT CUTTING EDGE AND METHOD FOR MAKING SAME

TECHNICAL FIELD

The present invention generally relates to a cutting edge .for snowplow blades and, more particularly, to a wear resistant cutting edge with carbide inserts.

BACKGROUND ART

Snowplow blades and the like are constructed with replaceable cutting edges so as to enable the removal and replacement of such cutting edge after it wears out. Such cutting edges are typically made of hardened steel. However, due to their running engagement against concrete and asphalt road surfaces, cutting edges are still subject to high rates of abrasive wear and need frequent replacement. Placing carbide on the leading edge of such cutting edges would greatly extend the wear life of the cutting edge. However, attempts to use carbide on cutting edges has only met with limited success. One reason is that carbide is extremely brittle and subject to fracture when subjected to high impact loads. If all or major portions of the carbide is lost due to breakage, its wear protecting ability is also lost and the extended life potential of cutting edge that should result from the carbide is not realized. Carbide is a high cost material. Not realizing its full life potential because of this loss results in undue economic waste. Another reason for its limited use is that carbide is difficult to attach to the steel cutting edge, such attachment typically being accomplished by an expensive brazing operation.

The present invention is directed to overcoming one or more of the preceding problems.

DISCLOSURE OF THE INVENTION

In accordance with one aspect of the present invention, a method of making a wear resistant cutting edge for a snowplow blade is disclosed which includes preparing an elongated steel cutting edge having a front face, a back face, a leading edge and opposite ends, and with a continuous, insert receiving slot in the leading edge extending from one of the opposite ends to the other end. A plurality of carbide inserts of a rectangular solid configuration are constructed with four sides and opposite planar faces and with a plurality of upstanding protuberances formed on one of the planar faces of the inserts. The inserts are placed in generally closely spaced, side by side relationship within the slot of the cutting edge and with the face of the protuberances facing one of the faces of the cutting edge. The leading edge is heated to a temperature of between about 1500 degrees to about 1800 degrees Fahrenheit and a press force is applied against the front and rear faces of the cutting edge along the leading edge sufficient to cause plastic deformation of the cutting edge around the protuberances to create a mechanical interlock between the cutting edge and the protuberances of the inserts.

In another aspect of the present invention, a wear resistant cutting edge for a snowplow blade is provided, which includes an elongated steel cutting edge having a front face, a rear face, a pair of opposite ends and a leading edge. The leading edge has a insert receiving slot formed therein extending from one of the ends to the other. The slot has a front side and an opposing rear side and is generally centrally located between and with the front and rear sides being generally parallel to the front and rear faces, respectively, of the cutting edge. A plurality of carbide inserts of a generally rectangular solid configuration are provided with a front face, a rear face and four sides and a plurality of upstanding protuberances formed on and extending beyond the rear face of the inserts. The inserts are located within the slot in closely spaced side by side relationship and with the protuberances located against one of the sides of the slot. The front and rear faces of the cutting edge are brought together along the slot to cause a mechanical interlock between the protuberances of the insert and the cutting edge.

BEST MODE FOR CARRYING OUT THE INVENTION

Figure 1:
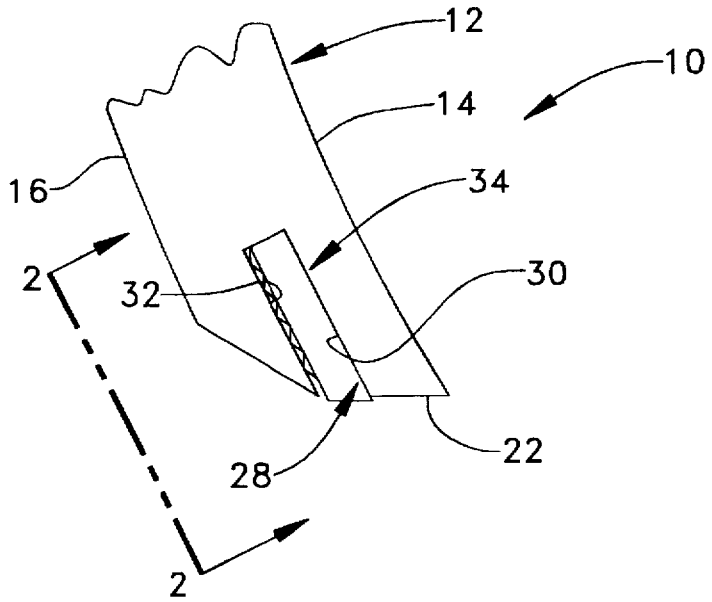
FIG. 1 is fragmentary side elevational view a wear resistant cutting edge embodying the principles of the present invention.
Figure 2:
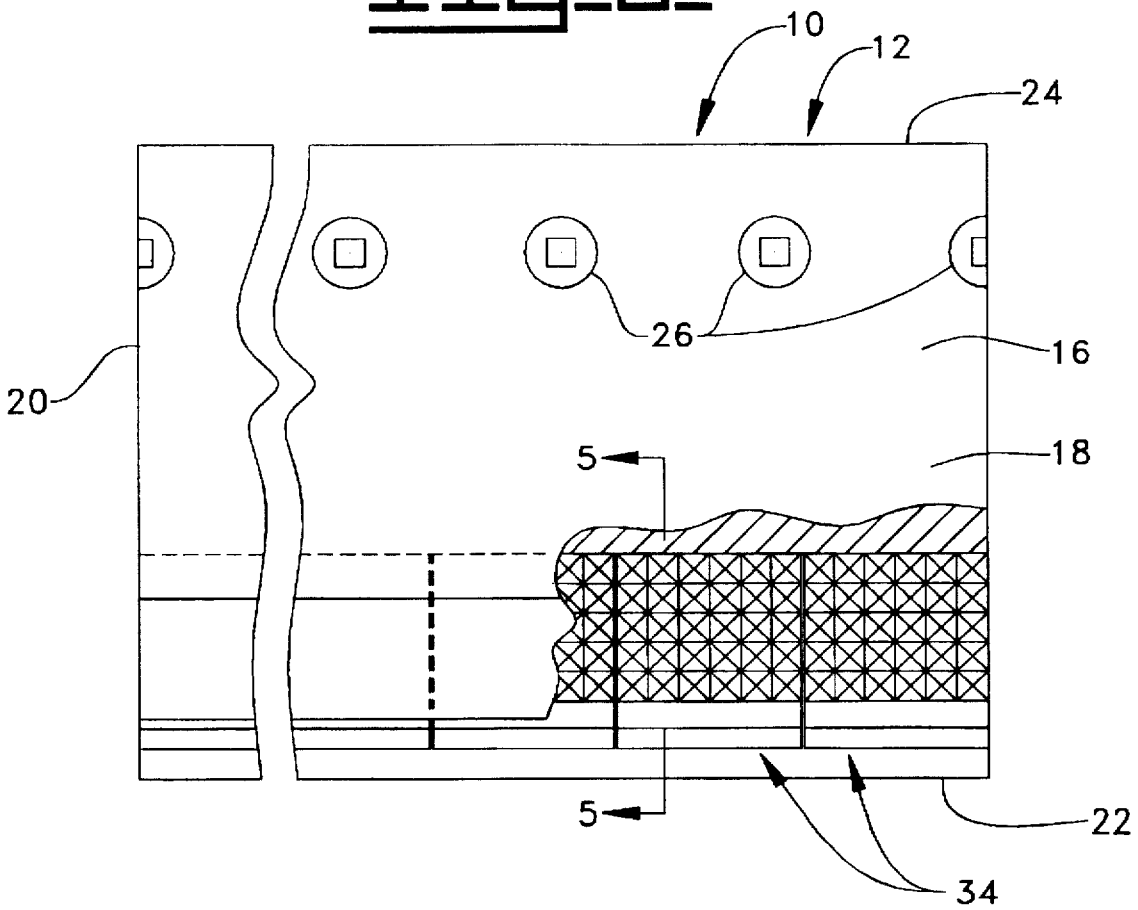
FIG. 2 is a rear view of the cutting edge taken along line 2—2 of FIG. 1, with a portion broken away to show the carbide inserts of the present invention.

Referring more particularly to the drawings, a replaceable, wear resistant cutting edge embodying the principles of the present invention is depicted at 10 in FIGS. 1 and 2 for use on a snowplow blade or the like (not shown). Snowplow blades are mounted on trucks or other vehicles (also not shown) and are used for removing snow and ice from roads, parking lots, airport runways and the like. Because road surfaces and the like are typically constructed from concrete or asphalt, snowplow blade cutting edges are subject to extremely high amounts of abrasive wear and must be frequently replaced with new cutting edges.

The wear resistant cutting edge 10 of the present invention is constructed to afford greater wear life by reducing such abrasive wear.

To this end, the cutting edge 10 includes an elongated steel cutting edge plate 12 having a front face 14, a rear face 16, a pair of opposite ends 18,20 and a leading edge 22. The plate also includes top edge 24, along which a plurality of plow bolt holes 26 may be provided for detachably securing the cutting edge plate 12 to the moldboard (not shown) of the snowplow blade. As such moldboards are typically curved, the edge plate 12 is preferably provided with a mating curved configuration, as shown in FIG. 1. However, plate 12 could be made straight as well.

The leading edge 22 has an insert receiving slot 28 formed therein. Slot 28 extends from one of the ends 18 to the other end 20. Slot 28 has a front side 30 and an opposing rear side 32 and is generally centrally located between and with the front and rear sides 30,32 being generally parallel to the front and rear faces 14,16, respectively, of the cutting edge plate 12.

The present cutting edge further includes a plurality of carbide inserts 34 of a generally rectangular solid configuration, with a front face 36, a rear face 38 and four sides 40,42,44,46, and a plurality of upstanding protuberances 48 formed on and extending beyond the rear face 38 of the inserts 34. The inserts 34 are located within the slot 28 in closely spaced side by side relationship and with their protuberances being located against and along the rear side 32 of the slot 28. A closely spaced relationship, rather than a tight abutting relationship, is necessary in order to accommodate the difference in thermal expansion between the steel cutting edge plate 12 and the carbide insert 34 when they become heated, which occurs during manufacture, as will hereinafter be more fully described, and/or during use of the cutting edge 10.

The inserts 34 may be made of a cemented carbide compound of tungsten carbide and 11 cobalt binder. However, the present invention is not intended to be limited to any particular compound as many any well known carbide compositions will function in the disclosed application, as those skilled in the art will appreciate.

Figure 3:
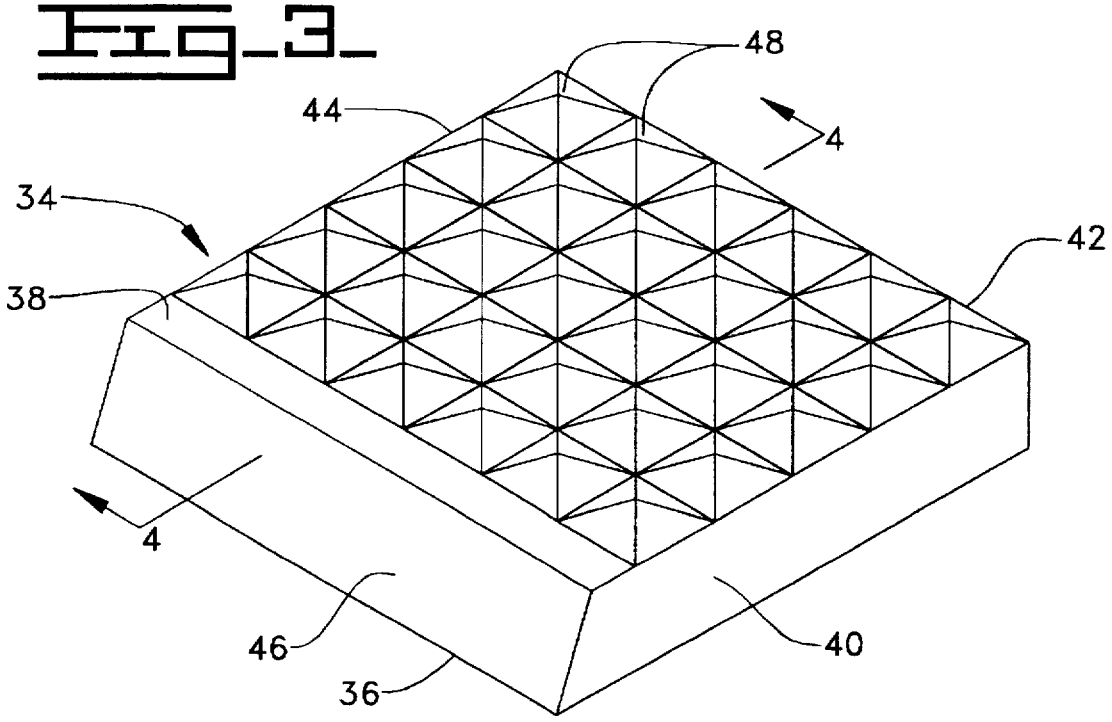
FIG. 3 an enlarged prospective view of one of the carbide inserts depicted in FIGS. 1 and 2 and illustrating one distribution pattern for the protuberances contained thereon.
Figure 4:
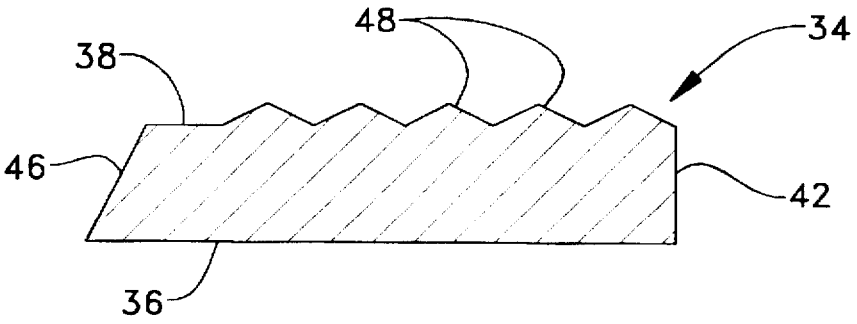
FIG. 4 is a cross-sectional view of one of the carbide inserts taken along line 4—4 of FIG. 3.

The inserts 34 have a thickness between the front and rear faces 36,38 of about 3 to 60 mm and preferably a thickness of about 6 mm. The inserts may have a width between sides 42,46 of between about 10 to 50 mm and a length between sides 40,44 of between about 10 to 150 mm. An insert with a width of about 25 mm and a length of about 25 mm has been used with satisfactory results. The protuberances 48 have a pyramidal-shaped configuration as best seen in FIGS. 3 and 4 and extend beyond the rear face 38 of the inserts 34 by about 5 to 20% of the thickness of the insert. For instance, a height of about 1 mm for the protuberances may be used for an insert that is about 6 mm thick.

Figure 3A:
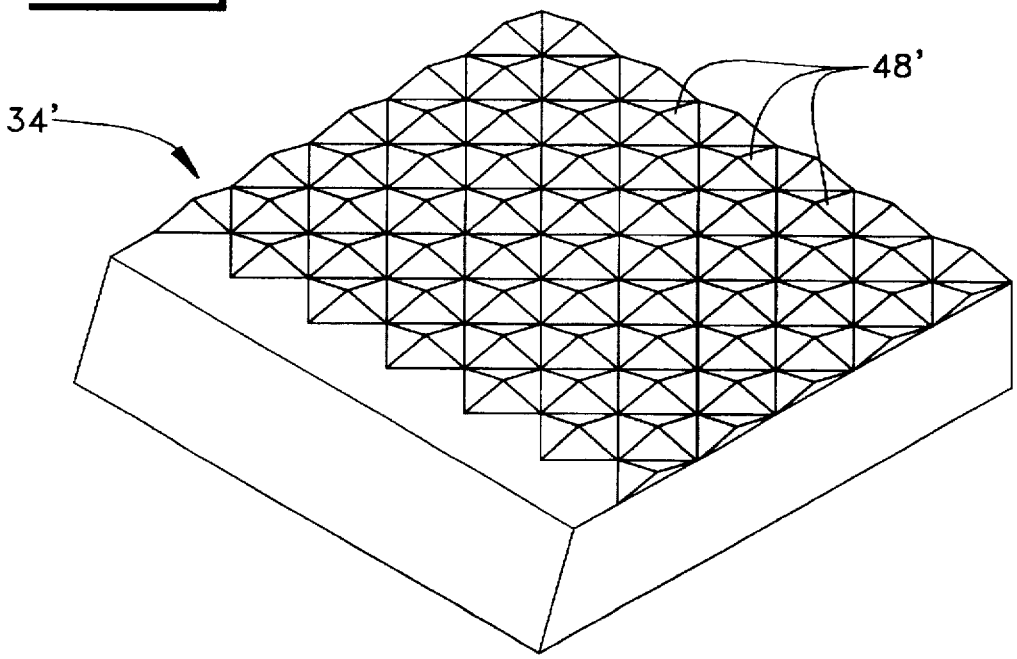
FIG. 3*a* is a view similar to FIG. 3, but illustrating another protuberance pattern.

As shown in FIG. 3, the protuberances are preferably arranged in columns and rows in a checkerboard like fashion. Alternately, an insert 34 may have the protuberances 48' that are arranged in diagonally oriented columns and rows, as shown in FIG. 3*a*.

Figure 5:
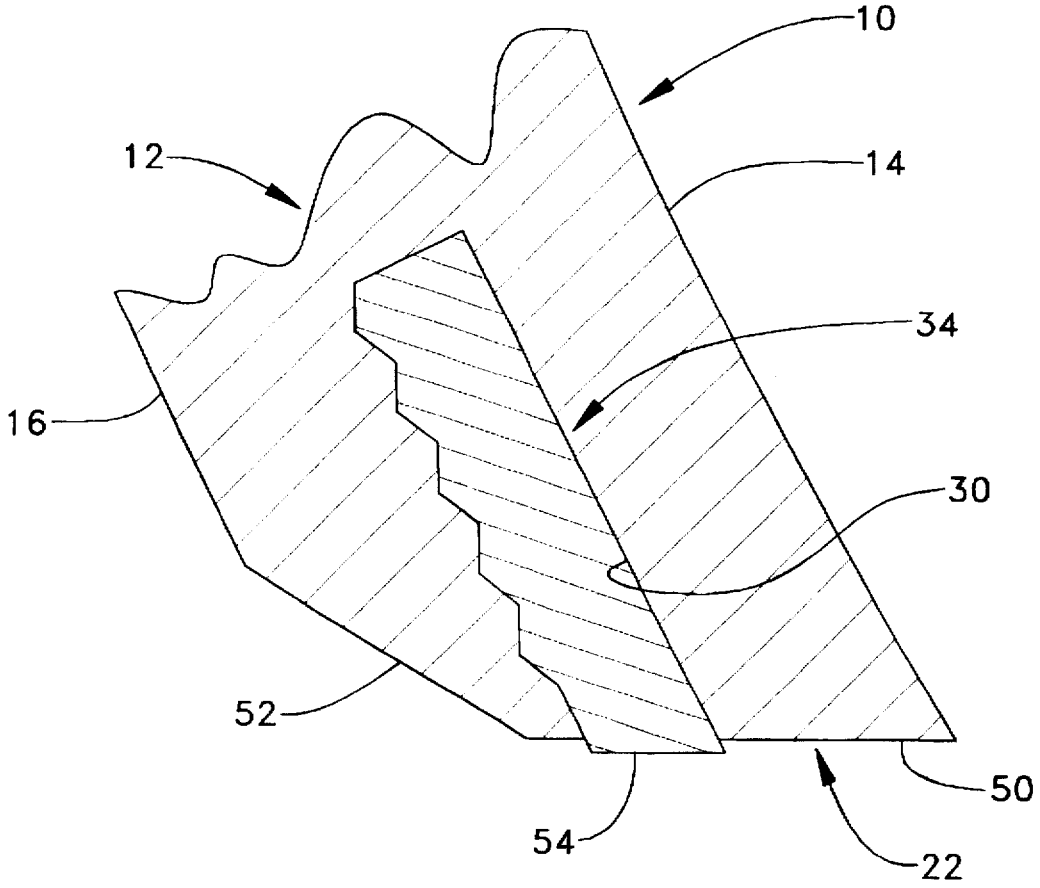
FIG. 5 is an enlarged cross-sectional view of the cutting edge taken generally along line 5—5 of FIG. 2.

As best shown in FIG. 5, the leading edge 22 of the cutting edge 10 is beveled with a first beveled surface 50 and a second beveled surface 52. The leading side 46 of the insert 34 is provided with a mating bevel surface 54 thereon that matches the first beveled surface 50, which, together, provide a sharp point that enhances to scraping ability of the cutting edge 10.

INDUSTRIAL APPLICABILITY

In accordance with the present invention, the cutting edge 10 is constructed in a manner to keep the carbide inserts 34 within the slot 28 during use by bringing the front and rear faces 14,16 of the cutting edge 10 together along the slot 28 to cause a mechanical interlock between the protuberances 48 of the insert 34 and the cutting edge 10. To accomplish this, the carbide inserts 34 are placed in generally closely spaced, side by side relationship within the slot 28 of the cutting edge 10 and with the rear face 38 with the protuberances 48 facing the rear face 16 of the cutting edge plate 12. The inserts 34 are preferably spaced a sufficient distance apart from each other to accommodate the difference in thermal expansion rates between the inserts and the steel cutting edge plate 12, thereby relieving stresses in the inserts 34 and possible breakage during use or during construction as described below.

The leading edge 20 of the cutting edge 10 is then heated to a temperature of between about 1500 degrees to about 1800 degrees Fahrenheit. While in a heated state, a press force by means of a hydraulic press or the like (not shown) is then applied against the front and rear faces 14,16 of the cutting edge 10 along the leading edge 22 sufficient to cause plastic deformation of the cutting edge plate 12 around the protuberances 48. This creates a mechanical interlock between the cutting edge 10 and the protuberances 48 of the inserts 34.

Because of metal flow around the protuberances 48, the insert 34 can not become dislodged from the slot 28 during use. The pyramidal shape of the protuberances 48 resists movement in both longitudinal and lateral directions. The use of many and the placement of the protuberances 48 in a checker board-like pattern reduces the amount of carbide loss in the event of breakage or cracking of the insert due to impact during use. This is because each protuberance 48 will retain any piece of carbide in which such protuberance resides, so that any cracking that occurs does not result in the loss large portions of the insert that might otherwise occur.

Other aspects, objects and advantages of this invention can be obtained for a study of the drawings, the disclosure and the appended claims.

We claim:

1. A method of making a wear resistant cutting edge for a snowplow blade, comprising:

preparing an elongated steel cutting edge having a front face, a back face, a leading edge and opposite ends, and with a continuous, insert receiving slot in the leading edge extending from one of said opposite ends to the other end;

constructing a plurality of carbide inserts of a rectangular solid configuration with four sides and opposite planar faces and with a plurality of upstanding protuberances formed on one of the planar faces of said inserts;

placing said inserts in generally closely spaced, side by side relationship within said slot of said cutting edge and with the face of said protuberances facing one of said faces of said cutting edge;

heating said leading edge to a temperature of between about 1500 degrees to about 1800 degrees Fahrenheit; and applying a press force against said front and rear faces of said cutting edge along said leading edge sufficient to cause plastic deformation of said cutting edge around said protuberances to create a mechanical interlock between said cutting edge and the protuberances of said inserts.

2. A wear resistant cutting edge for a snowplow blade, comprising:

an elongated steel cutting edge having a front face, a rear face, a pair of opposite ends and a leading edge, said leading edge having a insert receiving slot formed therein extending from one of said ends to the other, said slot having a front side and an opposing rear side and being generally centrally located between and with said front and rear sides being generally parallel to said front and rear faces, respectively, of said cutting edge; and a plurality of carbide inserts of a generally rectangular solid configuration with a front face, a rear face and four sides and a plurality of upstanding protuberances formed on and extending beyond the rear face of said inserts, said inserts being located within said slot in closely spaced side by side relationship and with said protuberances being located against one of said sides of said slot; and wherein the front and rear faces of said cutting edge are brought together along said slot to cause a mechanical interlock between said protuberances of said insert and said cutting edge.

3. The cutting edge of claim 2, wherein said inserts have a thickness between said front and rear faces of about 3 to 60 mm, and wherein said protuberance have a pyramidal-shaped configuration and extend beyond the rear face of said inserts by about 5 to 20% of said thickness of the insert, and wherein said protuberances are located against said rear side of said slot.

4. The cutting edge of claim 3, wherein said inserts have a height of between about 10 to 50 mm and a length of between about 10 to 150 mm.

5. The cutting edge of claim 4, wherein said protuberances are arranged in columns and rows.

6. The cutting edge of claim 4, wherein said protuberances are arranged in diagonally oriented columns and rows.

7. The cutting edge of claim 2, wherein said leading edge is beveled and wherein said insert has one of said four sides disposed along said cutting edge and is provided with a mating bevel thereon.

8. A carbide insert for insertion into a insert receiving slot of a cutting edge for a snowplow blade, comprising:

a generally rectangular solid configuration of carbide material having four sides, a pair of opposing planar faces, a predetermined thickness between said planar faces of about 3 to 60 mm, a width defined between a first opposing pair of said sides of about 10 to 50 mm and a length defined between a second opposing pair of said sides of about 10 to 150 mm; and a plurality of upstanding protuberances formed on at least one of said planar faces, said protuberances having a generally pyramidal configuration with a height above said one planar face of about 5 to 20% of said thickness of the insert and being arranged in columns and rows.

9. The insert of claim 8, wherein said thickness is about 6 mm, said width is about 25 mm, and said height of said protuberances is about 1 mm.

10. The insert of claim 8, wherein said length is about 25 mm.

* * * * *